US011744764B2

(12) United States Patent
Lee et al.

(10) Patent No.: US 11,744,764 B2
(45) Date of Patent: Sep. 5, 2023

(54) METHOD AND DEVICE FOR ASSISTING WALKING

(71) Applicant: Samsung Electronics Co., Ltd., Suwon-si (KR)

(72) Inventors: Jusuk Lee, Hwaseong-si (KR); Youngjin Park, Seoul (KR); Keehong Seo, Seoul (KR); Bokman Lim, Yongin-si (KR); Jun-Won Jang, Seoul (KR); Hyun Do Choi, Yongin-si (KR); Seungyong Hyung, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 979 days.

(21) Appl. No.: 16/171,511

(22) Filed: Oct. 26, 2018

(65) Prior Publication Data

US 2019/0209413 A1 Jul. 11, 2019

(30) Foreign Application Priority Data

Jan. 11, 2018 (KR) ..... 10-2018-0003823

(51) Int. Cl.
*A61H 3/00* (2006.01)
*A61H 1/00* (2006.01)

(52) U.S. Cl.
CPC ..... *A61H 3/00* (2013.01); *A61H 1/00* (2013.01); *A61H 2003/007* (2013.01); *A61H 2201/164* (2013.01); *A61H 2201/5007* (2013.01); *A61H 2201/5064* (2013.01); *A61H 2201/5069* (2013.01); *A61H 2201/5071* (2013.01); *A61H 2201/5084* (2013.01); *A61H 2230/085* (2013.01)

(58) Field of Classification Search
CPC .... A61H 3/00; A61H 2003/001; B25J 9/0006
See application file for complete search history.

(56) References Cited

U.S. PATENT DOCUMENTS 8,298,294 B2 10/2012 Kaltenborn et al.
9,415,205 B2 8/2016 Lasko et al.
(Continued)

FOREIGN PATENT DOCUMENTS

EP 02231096 A2 9/2010
KR 1320902 9/2013
(Continued)

OTHER PUBLICATIONS

Nedelkovski, What is Schmitt Trigger | How It Works, Aug. 24, 2015, How To Mechatronics. Access date Jun. 19, 2017. https://web.archive.org/web/20170619050809/https://howtomechatronics.com/how-it-works/electrical-engineering/schmitt-trigger/ (Year: 2015).*
(Continued)

*Primary Examiner* — Justine R Yu
*Assistant Examiner* — Christopher E Miller
(74) *Attorney, Agent, or Firm* — HARNESS, DICKEY & PIERCE, P.L.C.

(57) ABSTRACT

Provided is a method and device for assisting walking of a user that may receive a pressure value applied to a sole of a user from a pressure sensor, acquire acceleration information associated with a movement of the user from an acceleration sensor, determine a gait phase based on the pressure value and the acceleration information, determine an assist torque corresponding to the determined gait phase, and control a driver to output the assist torque.

11 Claims, 18 Drawing Sheets

(56) References Cited

U.S. PATENT DOCUMENTS

2004/0167641 A1* 8/2004 Kawai ..... B25J 9/0006 700/63
2006/0211956 A1* 9/2006 Sankai ..... A61F 5/0102 601/5
2006/0224247 A1* 10/2006 Clausen ..... A61F 2/66 623/47
2008/0234608 A1* 9/2008 Sankai ..... A61H 1/0244 601/5
2009/0222105 A1* 9/2009 Clausen ..... A61F 2/60 623/27
2010/0094188 A1* 4/2010 Goffer ..... A61H 1/0266 602/23
2010/0271051 A1* 10/2010 Sankai ..... A61H 1/0262 324/679
2012/0172770 A1* 7/2012 Almesfer ..... B25J 9/0006 601/35
2012/0226203 A1* 9/2012 Nakashima ..... A61H 3/00 601/34
2012/0259255 A1* 10/2012 Tomlinson ..... A61H 23/0218 601/46
2015/0134080 A1* 5/2015 Roh ..... B25J 9/0006 623/32
2016/0074272 A1* 3/2016 Ahn ..... A61B 5/1122 623/24
2016/0095538 A1* 4/2016 Lee ..... A61B 5/7267 600/595
2016/0184985 A1* 6/2016 Shim ..... B25J 9/1671 623/32
2016/0206499 A1* 7/2016 Shim ..... A61B 5/1038
2016/0229055 A1* 8/2016 Kim ..... B25J 9/0006
2016/0310342 A1* 10/2016 Lee ..... A61H 3/00
2016/0331557 A1* 11/2016 Tong ..... A61F 2/6607
2016/0331560 A1* 11/2016 Tong ..... A61B 5/112
2017/0007426 A1* 1/2017 Shin ..... A61F 5/0118
2017/0252255 A1* 9/2017 Asano ..... B25J 9/1615
2017/0268953 A1* 9/2017 Lee ..... B25J 13/085
2017/0333278 A1* 11/2017 Hyun ..... A61H 3/00
2017/0360644 A1* 12/2017 Hyun ..... A43B 3/0005
2018/0092794 A1* 4/2018 Murakami ..... A61H 1/0244
2018/0235830 A1* 8/2018 Rokosz ..... A61H 3/00
2018/0325764 A1* 11/2018 Yagi ..... B25J 11/009
2019/0000708 A1* 1/2019 Laffranchi ..... B25J 13/088
2019/0183713 A1* 6/2019 Sankai ..... A61B 5/0042
2019/0231573 A1* 8/2019 Lugrís Armesto .... A61F 5/0102
2019/0307583 A1* 10/2019 Herr ..... A61F 2/64
2020/0039061 A1* 2/2020 Sankai ..... B25J 9/0006
2021/0204836 A1* 7/2021 Sankai ..... A61B 5/1122

FOREIGN PATENT DOCUMENTS

KR 10-2015-0083331 A 7/2015
KR 10 2015 0085357 7/2015
KR 10 2015 0097237 A 8/2015
KR 1583369 1/2016
KR 1648270 5/2016
KR 2016009008 7/2016
KR 10-2017-0019175 A 2/2017
KR 1252634 10/2018
WO WO-2013067539 A1 * 5/2013 ..... A61F 9/08

OTHER PUBLICATIONS

Juri Taborri et al., "Gait Partitioning Methods: A Systematic Review", Sensors 2016, 16, 66,; doi:10.3390/s16010066; www.mdpi.com/journal/sensors.

Korean Office Action issued by Korean Intellectual Property Office (KIPO) dated Aug. 31, 2022 for the corresponding KR Patent Application No. 10-2018-0003823.

Korean Office Action issued by Korean Intellectual Property Office (KIPO) dated Mar. 20, 2023 for the corresponding KR Patent Application No. 10-2018-0003823.

* cited by examiner

METHOD AND DEVICE FOR ASSISTING WALKING

CROSS-REFERENCE TO RELATED APPLICATION

This application claims priority under 35 U.S.C. § 119 to Korean Patent Application No. 10-2018-0003823, filed on Jan. 11, 2018, in the Korean Intellectual Property Office, the entire contents of which are incorporated herein by reference in their entirety.

BACKGROUND

1. Field

Some example embodiments relate to a method and/or device for assisting walking of a user. For example, at least some example embodiments relate to a method and/or device for providing an assist force for walking assistance if a user is in a walking state.

2. Description of the Related Art

With the onset of aging societies, a growing number of people experience inconvenience and pain in walking due to reduced muscular strength or malfunctioning joint issues. Thus, interest in a walking assistance device that enables an elderly user or a patient with reduced muscular strength or joint problems to walk with less effort is growing. Also, walking assistance devices for enhancing muscular strength of a human body, for example, for military purposes are being developed.

SUMMARY

Some example embodiments relate to a walking assistance method performed by a walking assistance device.

In some example embodiment, the method includes receiving, from at least one pressure sensor, a pressure value indicating an amount of pressure applied to a sole of a user; receiving, from an acceleration sensor, acceleration information associated with a movement of the user; determining a gait phase of the user based on the pressure value and the acceleration information; determining an assist torque corresponding to the gait phase; and controlling a driver to output the assist torque.

In some example embodiment, the determining the gait phase includes determining whether a foot of the user is in contact with a ground based on the pressure value; and determining the gait phase based on whether the foot of the user is in contact with the ground.

In some example embodiment, the determining whether the foot of the user is in contact with the ground includes determining whether a change of a contact state occurs within a time period; maintaining a current contact state in response to the change of the contact state occurring within the time period; and determining whether the foot of the user is in contact with the ground based on the pressure value, in response to the change of the contact state not occurring within the time period.

In some example embodiment, the determining whether the foot of the user is in contact with the ground includes determining whether the foot of the user is in contact with the ground based on the pressure value using a Schmitt trigger threshold.

In some example embodiment, the determining whether the foot of the user is in contact with the ground includes receiving, from the at least one pressure sensor, a first pressure value indicating the amount of pressure applied to the sole of the user at a first time; receiving, from the at least one pressure sensor, a second pressure value indicating the amount of pressure applied to the sole of the user at a second time, the second time being different from the first time; and determining whether the foot of the user is in contact with the ground based on the first pressure value and the second pressure value.

In some example embodiment, the determining whether the foot of the user is in contact with the ground further includes receiving, from a first pressure sensor of the at least one pressure sensor, the first pressure value; receiving, from a second pressure sensor of the at least one pressure sensor, the second pressure value, the first pressure sensor and the second pressure sensor being provided at different locations of the foot of the user; and determining whether the foot of the user is in contact with the ground based on the first pressure value and the second pressure value.

In some example embodiment, the determining of the gait phase includes determining whether the user is in a walking state based on the acceleration information; and determining whether a foot of the user is in contact with a ground in response to the user being in the walking state.

In some example embodiment, the determining whether the user is in the walking state includes calculating a magnitude of acceleration of the user based on the acceleration information; determining that the user is in the walking state in response to the magnitude of acceleration being greater than an acceleration threshold; and determining that the user is in a stand state in response to the magnitude of acceleration being less than or equal to the acceleration threshold.

In some example embodiment, the determining of the gait phase includes determining a target gait phase corresponding to gait information among preset gait phases.

In some example embodiment, the driver is configured to provide the assist torque to an ankle of the user.

In some example embodiment, the controlling of the driver includes calculating a desired length of a support frame corresponding to the assist torque; and controlling the driver to adjust an actual length of the support frame to the desired length.

Some example embodiment relate to a non-transitory computer-readable recording medium storing instructions that, when executed by a processor, cause the processor to perform the walking assistance method.

Some example embodiments relate to a walking assistance device.

In some example embodiment, the walking assistance device includes a memory configured to store a program to assist a user with walking; and a processor configured to execute the program to, receive, from at least one pressure sensor, a pressure value indicating an amount of pressure applied to a sole of a user, receive, from an acceleration sensor, acceleration information associated with a movement of the user, determine a gait phase of the user based on the pressure value and the acceleration information, determine an assist torque corresponding to the gait phase, and control a driver to output the assist torque.

In some example embodiment, the processor is configured to determine the gait phase by, determining whether a foot of the user is in contact with a ground based on the pressure value, and determining the gait phase based on whether the foot of the user is in contact with the ground.

In some example embodiment, the processor is configured to determine whether the foot of the user is in contact with the ground by, determining whether a change of a contact state is occurs within a time period, maintaining a current contact state in response to the change of the contact occurring within the time period, and determining whether the foot of the user is in contact with the ground based on the pressure value in response to the change of the contact state not occurring within the time period.

In some example embodiment, the processor is configured to determine whether the foot of the user is in contact with the ground based on the pressure value using a Schmitt trigger threshold.

In some example embodiment, the processor is configured to determine whether the foot of the user is in contact with the ground by, receiving, from the at least one pressure sensor, a first pressure value indicating the amount of pressure applied to the sole of the user at a first time, receiving, from the at least one pressure sensor, a second pressure value indicating the amount of pressure applied to the sole of the user at a second time, the second time being different from the first time, and determining whether the foot of the user is in contact with the ground based on the first pressure value and the second pressure value.

In some example embodiment, the processor is configured to determine the gait phase by, determining whether the user is in a walking state based on the acceleration information, an determining whether a foot of the user is in contact with a ground in response to the user being in the walking state.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
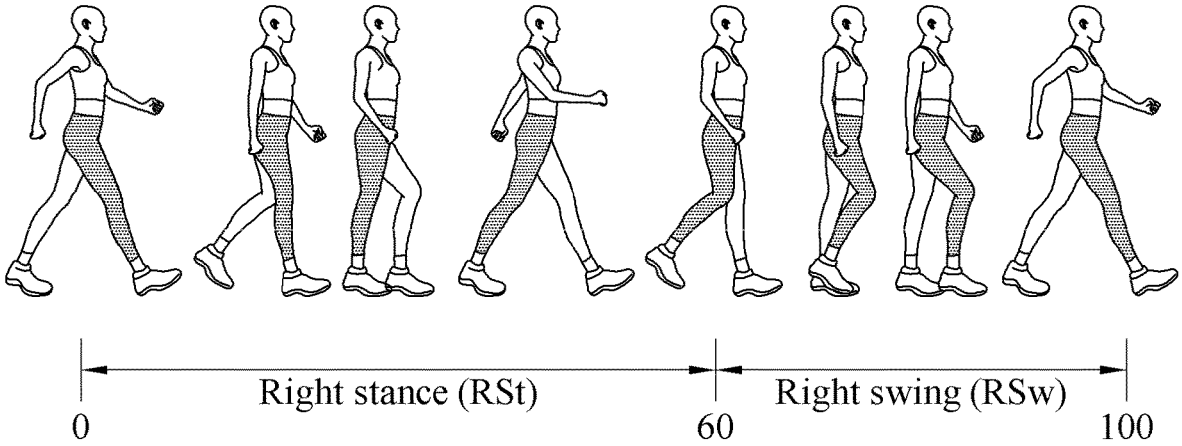
FIG. 1 illustrates an example of a gait state according to at least one example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions may be omitted when it is deemed that such description will cause ambiguous interpretation of the present disclosure.

It should be understood, however, that there is no intent to limit example embodiments to the particular example embodiments disclosed herein. On the contrary, the example embodiments are to cover all modifications, equivalents, and alternatives falling within the scope of the example embodiments. Like numbers refer to like elements throughout the description of the figures.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Various example embodiments will now be described more fully with reference to the accompanying drawings in which some example embodiments are shown. In the drawings, the thicknesses of layers and regions are exaggerated for clarity.

FIG. 1 illustrates an example of a gait state according to at least one example embodiment.

Gait phases of one leg of a user for a gait may be defined (or, alternatively, predefined). For example, the gait phases may include a stance and a swing. Gait phases of a left leg may be classified into a left stance LSt and a left swing LSw. Gait phases of a right leg may be classified into a right stance RSt and a right swing RSw.

A gait cycle associated with gait phases may be mapped to a finite state machine (FSM). For example, a gait cycle of 0% may be mapped at a point in time at which the stance starts, the gait cycle of 60% may be mapped at a point in time at which the swing starts, and the gait cycle of 100% may be mapped at a point in time just before the stance starts.

According to an example embodiment, the stance and the swing may be further sub-divided into a plurality of phases. For example, the support may be sub-divided into an initial contact, a weight bearing, a middle stance, a terminal stance, and a pre-swing. The swing may be sub-divided into an initial swing, a middle swing, and a terminal swing. The example embodiment is provided as an example only, and the stance and the swing may be differently sub-divided.

Figure 2:
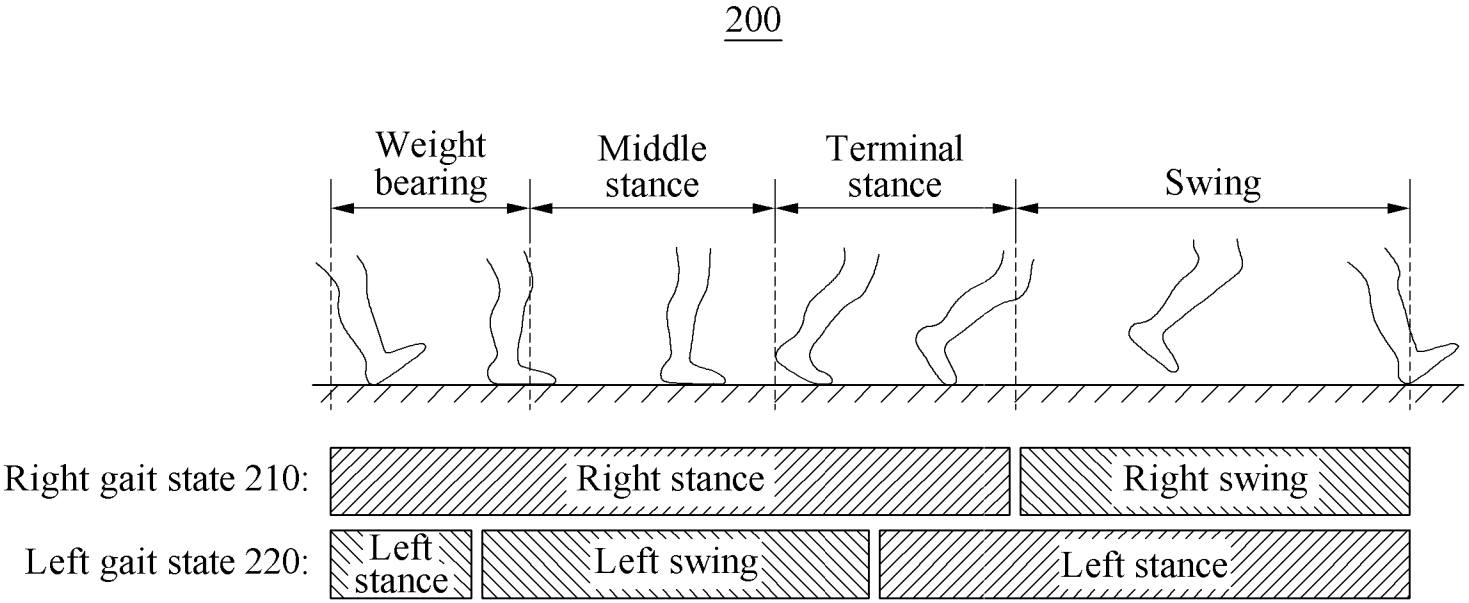
FIG. 2 illustrates an example of a transition between gait states according to at least one example embodiment.

FIG. 2 illustrates an example of a transition between gait states according to at least one example embodiment.

According to a general gait mechanism, gait phases of each leg include a stance and a swing, and the stance and the swing are alternately performed for a gait.

A right gait state 210 associated with a change 200 of a right leg includes a right stance and a right swing. The stance may include a weight bearing, a middle stance, and a terminal stance, however, is not limited thereto. A left gait state 220 associated with a change of a left leg (not shown) relative to the change 200 of the right leg includes a left stance and a left swing.

A normal transition between gait states may differ based on a gait state at a point in time at which a gait starts. The gait states may be transited in order of the right stance, the left swing, the left stance, and the right swing based on occurrence order of an event indicating a start of each gait state. The right stance is performed again after the right swing.

If muscular strength of an ankle of a user is reduced due to aging or diseases of the user, the user may experience discomfort with walking. For example, an end of a foot of the user needs to be lifted to swing a leg. Otherwise, the leg to swing may hit a floor. That is, an angle of an ankle needs to be adjusted in response to the progress of a gait phase or a change of the gait phase. A walking assistance device may be provided to a user having difficulty in adjusting an angle of an ankle by himself or herself due to the reduced muscular strength of the ankle. The walking assistance device may be worn around the ankle of the user, determine a gait phase of the user, and output an assist torque corresponding to the determined gait phase. The ankle angle of the user may be adjusted based on the assist torque.

A current gait phase of the user may be determined based on at least whether the sole of the foot of the user is in contact with the ground. However, it may be difficult to accurately determine whether the sole of the foot of the user is in contact with the ground based on an amount of pressure applied to the sole of the foot.

Hereinafter, a method of assisting walking of a user by providing an assist torque to an ankle of the user will be described with reference to FIGS. 3 through 18.

Figure 3:
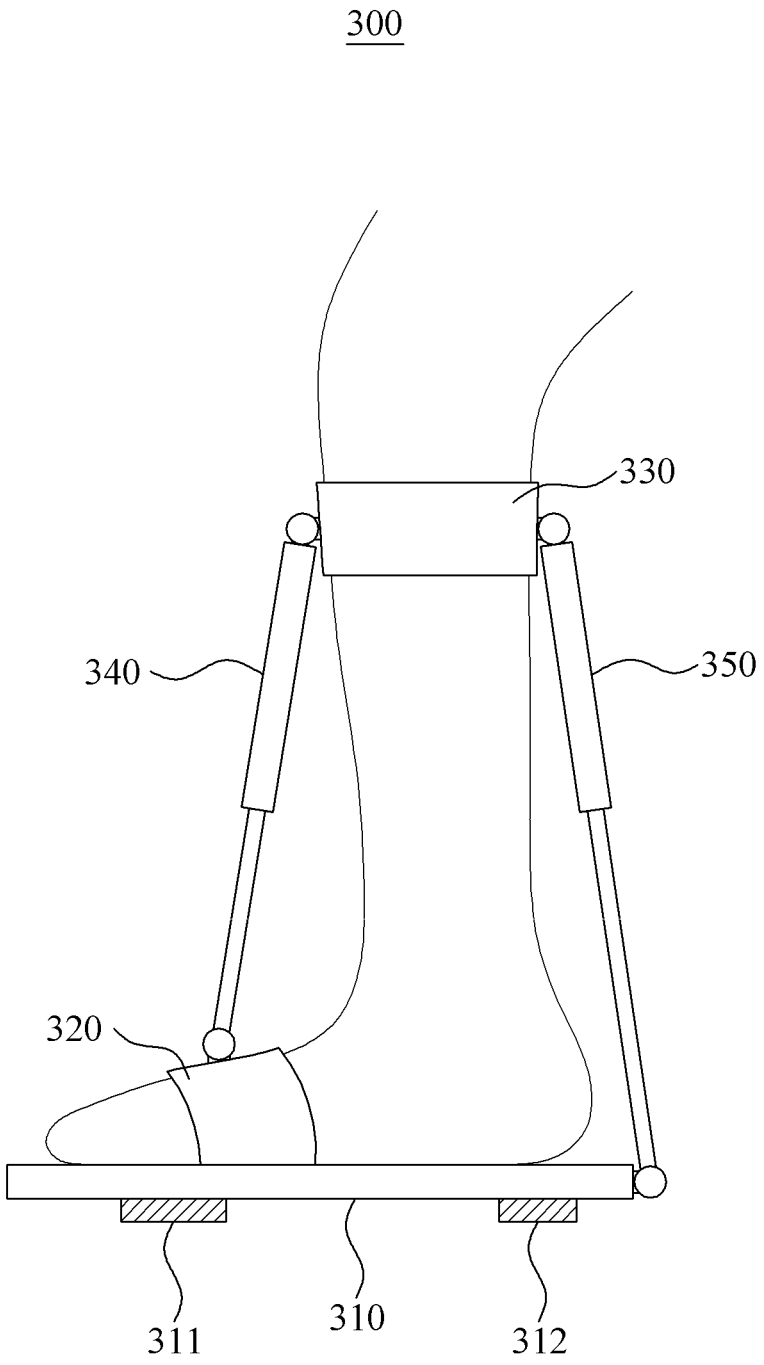
FIG. 3 illustrates an example of a walking assistance device according to at least one example embodiment.

FIG. 3 illustrates an example of a walking assistance device according to at least one example embodiment.

Referring to FIG. 3, a walking assistance device 300 includes a sole frame 310, a front pressure sensor 311, a rear pressure sensor 312, a lower end coupler 320, an upper end coupler 330, a first support frame 340, and a second support frame 350.

For example, the front pressure sensor 311 is provided to a front sole of a foot to measure pressure applied to a wide portion of the sole and the rear pressure sensor 312 is provided to a rear sole of the foot to measure pressure applied to a heel of the foot.

The first support frame 340 connects the lower end coupler 320 and the upper end coupler 330. The lower end coupler 320 is connected to the sole frame 310. The second support frame 350 connects the sole frame 310 and the upper end coupler 330. The upper end coupler 330 may be worn around a calf or shin of the user.

A length of the first support frame 340 and a length of the second support frame 350 may be adjusted. For example, the length of the first support frame 340 and the length of the second support frame 340 may be adjusted by a driver (not shown). The driver may adjust the length of the first support frame 340 and the length of the second support frame 340 using a mechanical device.

If the length of the first support frame 340 decreases and the length of the second support frame 350 increases, the ankle of the user may be lifted. On the contrary, if the length of the first support frame 340 increases and the length of the second support frame 350 decreases, the ankle of the user may be stretched.

Although the walking assistance device 300 includes the first support frame 340 and the second support frame 350, it is provided as an example only. For example, the walking assistance device 300 may include a single first support frame 340 and may also include three or more support frames.

Figure 4:
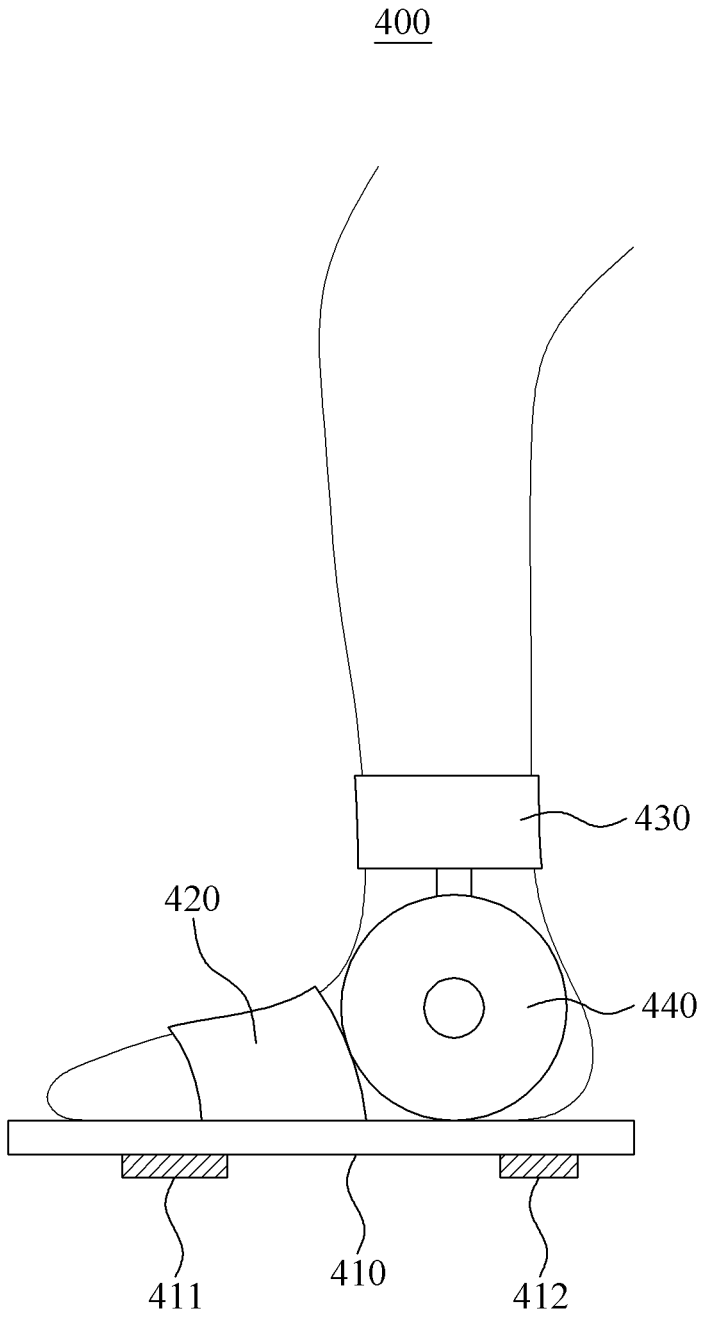
FIG. 4 illustrates another example of a walking assistance device according to at least one example embodiment.

FIG. 4 illustrates another example of a walking assistance device according to at least one example embodiment.

Referring to FIG. 4, a walking assistance device 400 includes a sole frame 410, a front pressure sensor 411, a rear pressure sensor 412, a lower end coupler 420, an upper end coupler 430, and a motor 440.

For example, the front pressure sensor 411 is provided to a front sole of a foot to measure pressure applied to a wide portion of the sole and the rear pressure sensor 412 is provided to a rear sole of the foot to measure pressure applied to a heel of the foot.

The motor 440 connects the lower end coupler 420 and the upper end coupler 430. A driver (not shown) may control the motor 440 to output a torque. In response to the torque output from the motor 440, an angle between the lower end coupler 420 and the upper end coupler 430 may be adjusted. For example, in response to a decrease in the angle between the lower end coupler 420 and the upper end coupler 430, an ankle of the user may be lifted. As another example, in response to an increase in the angle between the lower end coupler 420 and the upper end coupler 430, the ankle of the user may be stretched.

Hereinafter, a method of assisting walking of a user will be described with reference to FIGS. 5 through 18.

Figure 5:
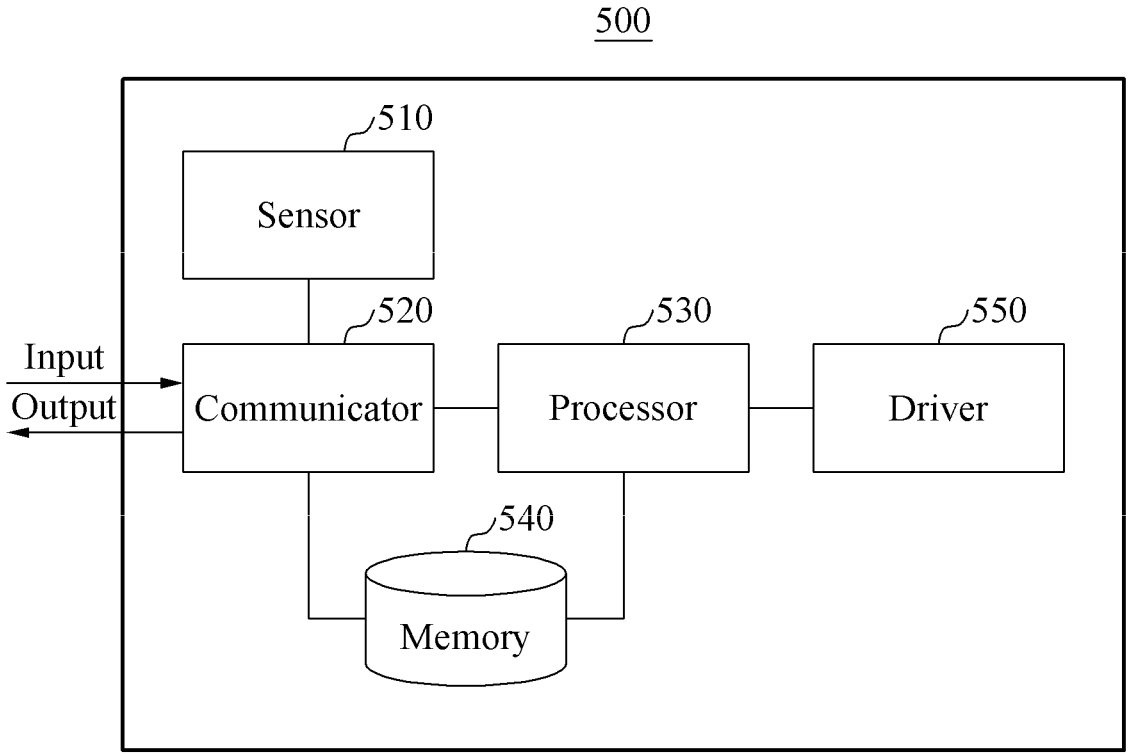
FIG. 5 is a diagram illustrating an example of a walking assistance device according to at least one example embodiment.

FIG. 5 is a diagram illustrating an example of a walking assistance device according to at least one example embodiment.

Referring to FIG. 5, a walking assistance device 500 includes at least one sensor 510, a communicator 520, a processor 530, a memory 540, and a driver 550. The walking assistance device 500 may correspond to the walking assistance device 300 of FIG. 3 and/or the walking assistance device 400 of FIG. 4. The walking assistance device 500 may be an ankle exoskeleton device.

The at least one sensor 510 may include a pressure sensor and an inertia measurement unit (IMU). The pressure sensor may convert a magnitude of pressure applied to the pressure sensor to a voltage form and may output the converted pressure. The IMU may measure acceleration occurring by a movement of the IMU. For example, the IMU may measure acceleration with respect to three axes.

The communicator 520 is connected to the sensor 510, the processor 530, and the memory 540 to transmit and receive data. The communicator 520 is connected to an external device to transmit and receive data. Hereinafter, transmitting and receiving "A" may represent transmitting and receiving "information or data that indicates A".

The communicator 520 may be configured as a circuitry within the walking assistance device 500. For example, the communicator 520 may include an internal bus and an external bus. As another example, the communicator 520 may refer to a component that connects the walking assistance device 500 and the external device. The communicator 520 may be an interface. The communicator 520 may receive data from the external device and may transmit the data to the processor 530 and the memory 540.

The processor 530 processes data received by the communicator 520 and data stored in the memory 540. Here, the processor 530 may be a data processing device embodied by hardware including a circuitry having a physical structure to execute desired operations. The operations may include, for example, codes and instructions included in a program. The data processing device embodied by hardware may include, for example, a microprocessor, a central processing unit (CPU), a processor core, a multi-core processor, a multiprocessor, an application-specific integrated circuit (ASIC), and a field programmable gate array (FPGA).

The processor 530 executes a computer-readable code, for example, software, stored in the memory 540 and instructions caused by the processor 530.

The memory 540 stores data received by the communicator 520 and data processed by the processor 530. For example, the memory 540 may store the program. The stored program may be a set of syntaxes that are coded and executable by the processor 220 to assist walking of the user.

The memory 540 may include, for example, at least one volatile memory, nonvolatile memory, random memory access (RAM), flash memory, a hard disk drive, and an optical disk drive.

The memory 540 stores an instruction set, for example, software, for operating the walking assistance device 500. The instruction set for operating the walking assistance device 500 is executed by the processor 530.

The driver 550 may include mechanical devices configured to adjust an angle of an ankle of the user. For example, the driver 550 may include a motor, and a torque output from the motor may be used to adjust the angle of the ankle. As another example, the driver 550 may include a power conversion device capable of adjusting a length of a support frame. The power conversion device may convert a rotary motion caused by the driver 550 to a linear motion.

A further description related to the sensor 510, the communicator 520, the processor 530, the memory 540, and the memory 550 will be made with reference to FIGS. 6 through 18.

Figure 6:
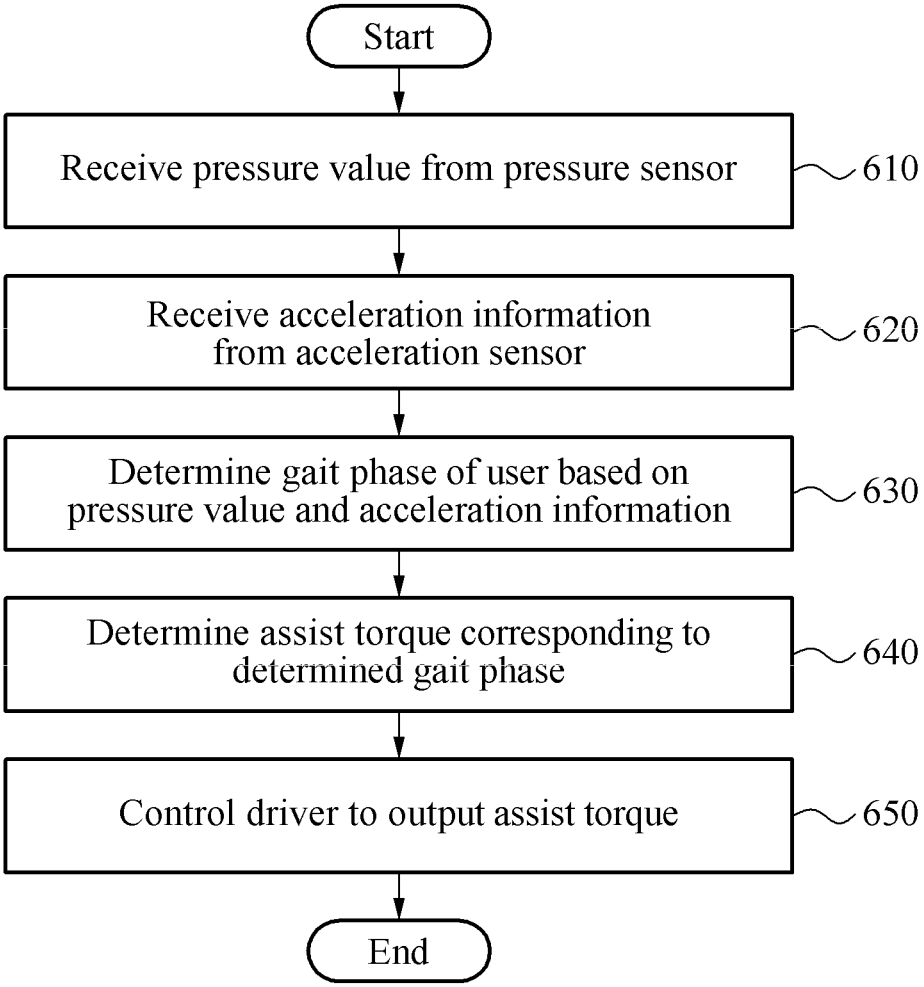
FIG. 6 is a flowchart illustrating a walking assistance method according to at least one example embodiment.

FIG. 6 is a flowchart illustrating a walking assistance method according to at least one example embodiment.

Operations 610 through 650 of FIG. 6 may be performed by the walking assistance device 500 of FIG. 5.

Referring to FIG. 6, in operation 610, the walking assistance device 500 receives a pressure value applied to a sole of a user from a pressure sensor. For example, the sensor 510 includes at least one pressure sensor. The pressure sensor may measure a pressure value caused by a gait of the user.

In operation 620, the walking assistance device 500 receives acceleration information associated with a movement of the user from an acceleration sensor. The sensor 510 includes the acceleration sensor and the acceleration sensor may be an IMU.

In operation 630, the walking assistance device 500 determines a gait phase of the user based on the pressure value and the acceleration information. For example, the walking assistance device 500 determines whether the gait phase of the user is a stance or a swing based on the pressure value. A method of determining the gait phase of the user will be further described with reference to FIGS. 7 through 12.

In operation 640, the walking assistance device 500 determines an assist torque corresponding to the determined gait phase. For example, the walking assistance device 500 may calculate an assist torque corresponding to a stance or a swing. A level of a gait cycle may be determined based on the gait phase and an assist torque that matches the determined level of the gait cycle may be calculated. A trajectory of the assist torque may be preset with respect to the gait cycle.

In operation 650, the walking assistance device 500 controls the driver 550 to output the assist torque. A method of controlling a driver will be described with reference to FIG. 13.

Figure 7:
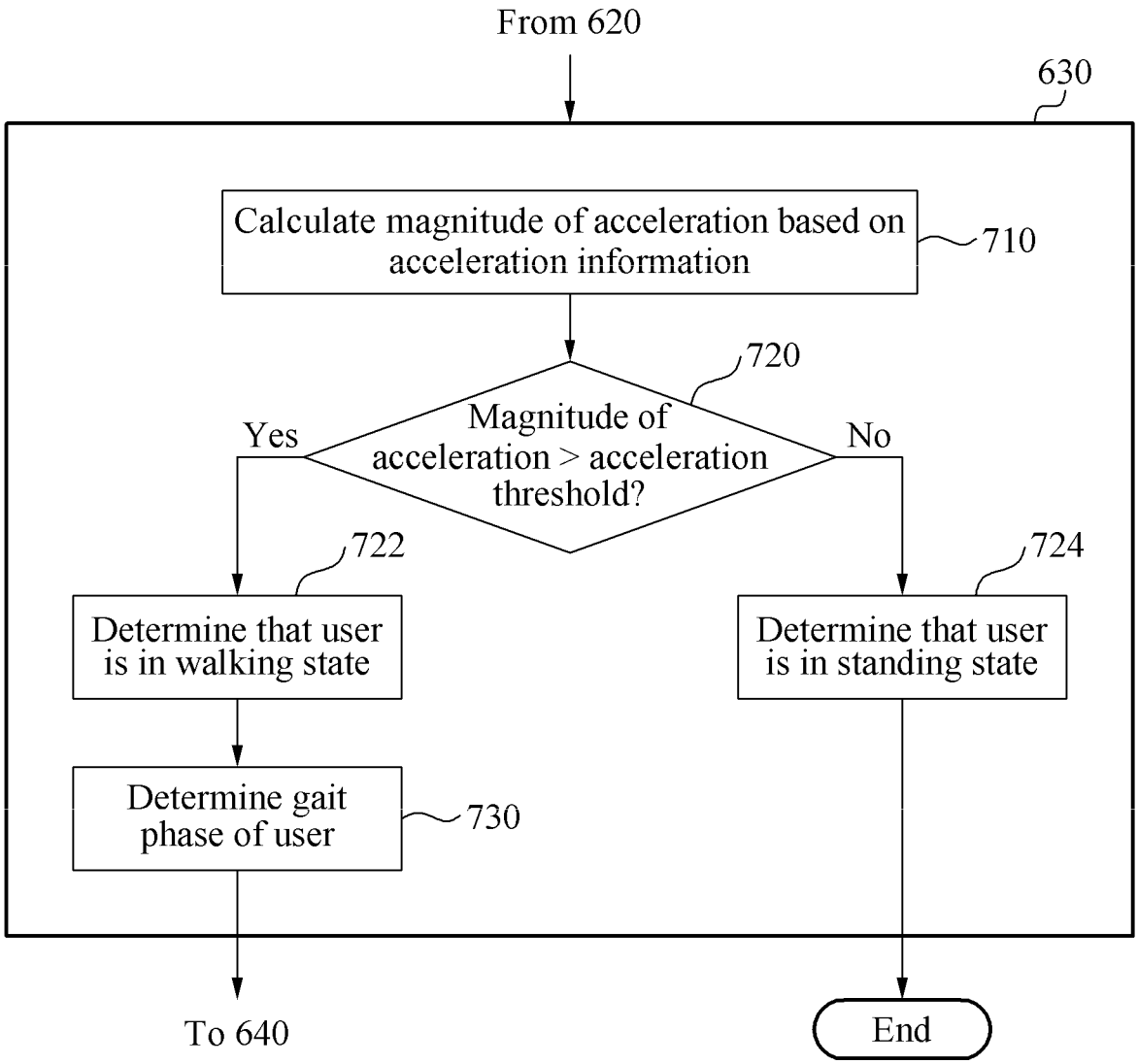
FIG. 7 is a flowchart illustrating a method of determining a state of a user based on acceleration information according to at least one example embodiment.

FIG. 7 is a flowchart illustrating a method of determining a gait phase of a user based on gait information according to at least one example embodiment.

A user may change a posture of the user while standing in place. In response to the change of the posture, pressure applied to a sole of the user may also change. For example, if the user is standing with a left leg of the user being centered, pressure applied to a sole of a right leg of the user may be reduced.

The walking assistance device 500 may determine whether the user is walking and may determine a gait phase of the user only when the user is in a walking state. Therefore, the walking assistance device 500 may increase the accuracy of detecting whether the sole of the foot of the user is in contact with the ground, and, thus increase the accuracy of the detected gait phase.

Operation 630 of FIG. 6 may include operations 710, 720, 722, 724, and 730 of FIG. 7. A gait state of the user may be determined based on acceleration information through operations 710, 720, 722, and 724.

Referring to FIG. 7, in operation 710, the walking assistance device 500 calculates a magnitude of acceleration based on acceleration information. For example, a norm of acceleration values of three axes may be calculated.

In operation 720, the walking assistance device 500 determines whether the magnitude of acceleration is greater than a preset acceleration threshold.

In operation 722, the walking assistance device 500 determines that the user is in a walking state in response to the magnitude of acceleration being greater than the preset acceleration threshold. The determined gait state may be maintained during a preset period.

In operation 730, the walking assistance device 500 determines the gait phase of the user based on the pressure value. A method of determining the gait phase will be further described with reference to FIGS. 8 through 12.

In operation 724, the walking assistance device 500 determines that the user is in a standing state in response to the magnitude of acceleration being less than or equal to the preset acceleration threshold.

If the user is determined to be in the standing state, the walking assistance device 500 may control the driver 550 to assist the standing state of the user. For example, the driver 550 may control an ankle of the user so that a center of gravity of the user may be placed on a front sole of the user.

Figure 8:
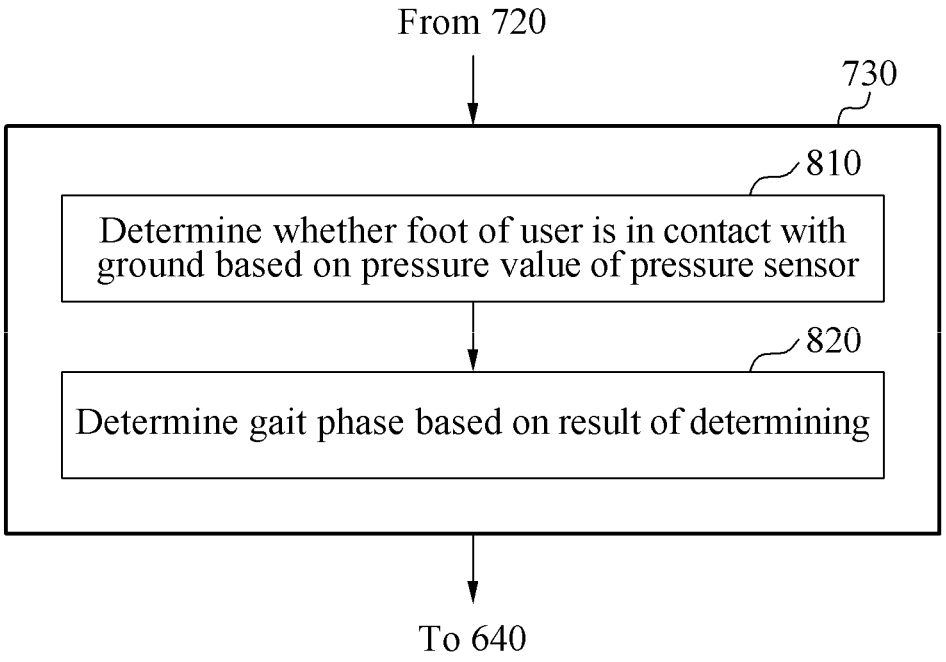
FIG. 8 is a flowchart illustrating a method of determining a gait phase of a user based on gait information according to at least one example embodiment.

FIG. 8 is a flowchart illustrating a method of determining a gait phase of a user based on gait information according to at least one example embodiment.

Operation 730 of FIG. 7 may include operations 810 and 820 of FIG. 8.

Referring to FIG. 8, in operation 810, the walking assistance device 500 determines whether a foot of a user is in contact with the ground based on a pressure value of a pressure sensor that is provided to a sole of the user. For example, if a single pressure sensor is present and the pressure value is greater than a threshold, the foot of the user may be determined to be in contact with the ground. As another example, if a plurality of pressure sensors is present and at least one of a plurality of pressure values is greater than the threshold, the foot of the user may be determined to be in contact with the ground.

Noise may be included in a pressure value. Noise may occur in an internal circuit of the pressure sensor. If the foot of the user is determined to be in contact with the ground based on the threshold, a result of (hereinafter, also referred to as a contact result) determining whether the foot of the user is in contact with the ground may frequently change due to noise of the pressure value occurring around the threshold. Such a phenomenon is referred to as a chattering phenomenon. The chattering phenomenon will be described with reference to FIG. 9.

Whether the foot of the user is in contact with the ground may be determined to avoid a frequent change of the contact result. Example embodiments of reducing (or, alternatively, preventing) the chattering phenomenon will be described with reference to FIGS. 10 through 12.

In operation 820, the walking assistance device 500 determines the gait phase based on a result of the determining. If the foot of the user is determined to be in contact with the ground, the walking assistance device 500 determines the gait phase of the user as a stance. Otherwise, the walking assistance device 500 determines the gait phase of the user as a swing.

Figure 9:
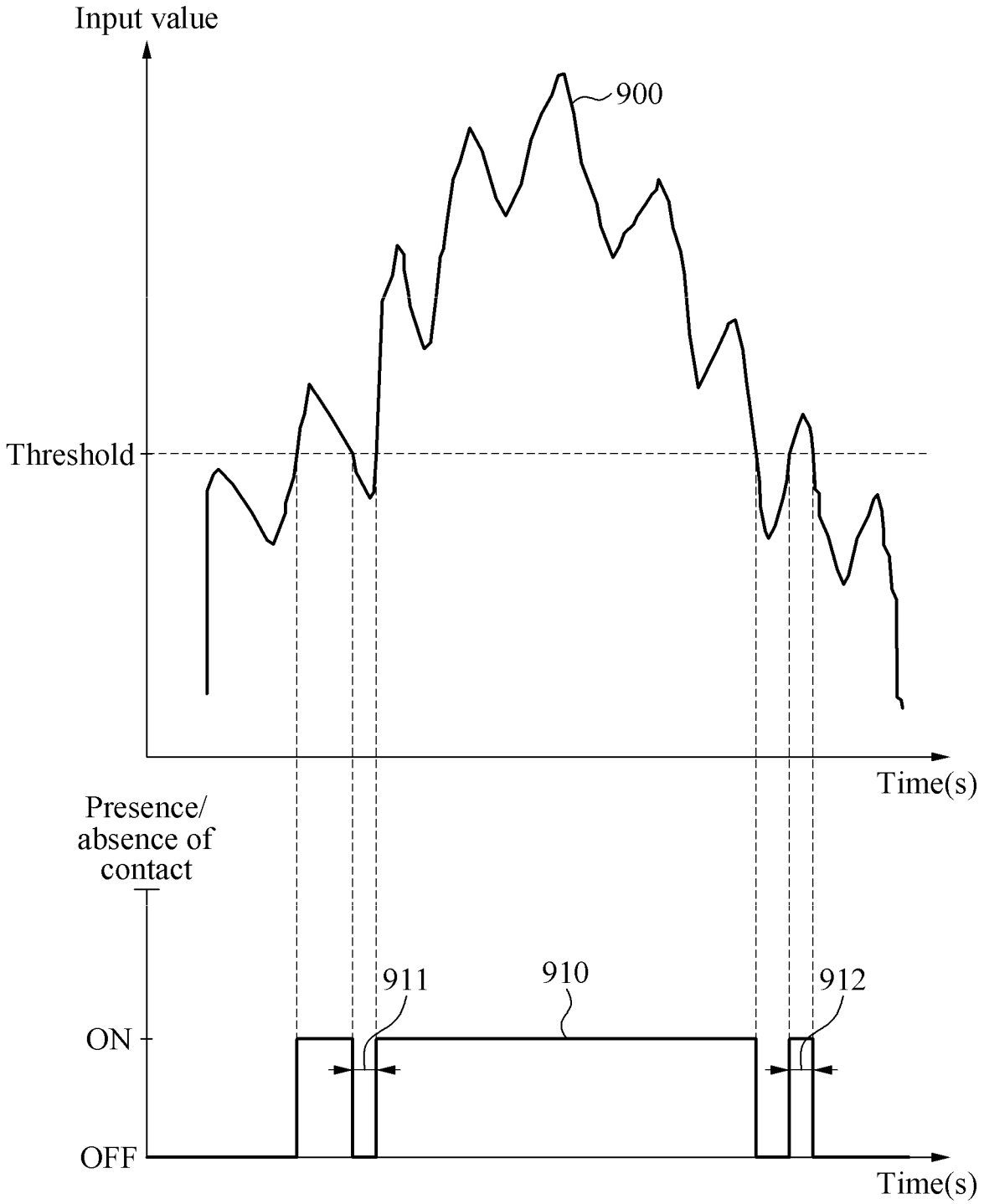
FIG. 9 illustrates a chattering phenomenon by noise according to at least one example embodiment.

FIG. 9 illustrates a chattering phenomenon by noise according to at least one example embodiment.

A pressure value graph 900 of FIG. 9 shows a case in which an actual gait phase changes to a swing, a stance, and the swing. Unless a pressure value is greater than a threshold, the gait phase is determined as the swing. If the pressure value is greater than the threshold, the gait phase is determined as the stance. A contact presence/absence graph 910 corresponding to the pressure value graph 900 may be generated.

Referring to the pressure value graph 900, noise occurs around the threshold. First chattering 911 appears due to noise that occurs in a phase from a swing to a stance and second chattering 912 appears due to noise that occurs in a phase from the stance to the swing.

Figure 10:
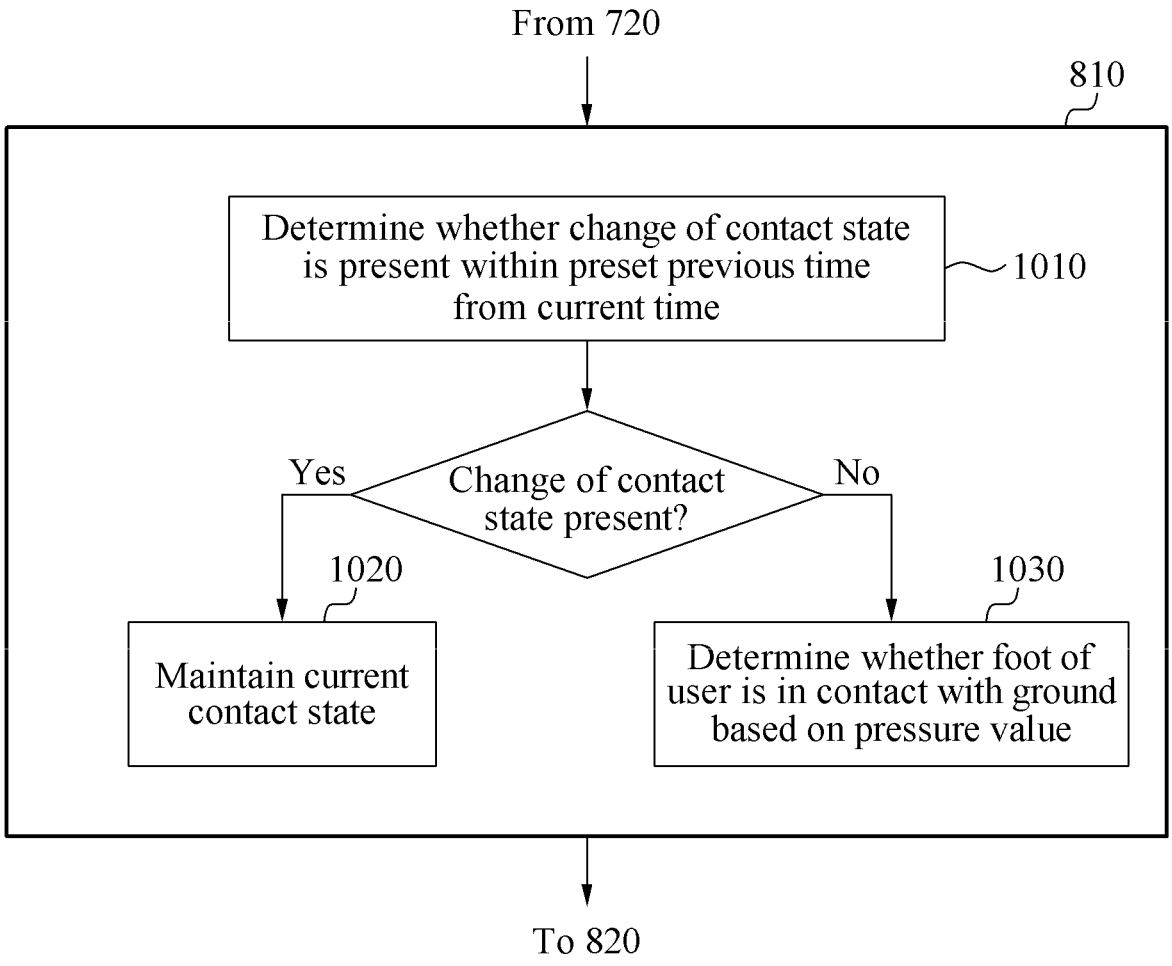
FIG. 10 is a flowchart illustrating a method of determining whether a foot of a user is in contact with the ground according to at least one example embodiment.

FIG. 10 is a flowchart illustrating a method of determining whether a foot of a user is in contact with the ground according to at least one example embodiment.

Operation 810 of FIG. 8 may include operations 1010 through 1030 of FIG. 10.

Referring to FIG. 10, in operation 1010, the walking assistance device 500 determines whether a change of a contact state is present within a preset previous time from a current time. For example, whether the change of the contact state is present within 10 milliseconds (ms) from the current time may be determined.

Operation 1020 is performed in response to the change of the contact state being present within the previous time and operation 1030 is performed in response to the change of the contact state being absent.

In operation 1020, the walking assistance device 500 determines the contact state that is determined within a preset previous time as a current contact state. The chattering phenomenon by noise may be reduced (or, alternatively, prevented) by maintaining the previous contact state as is.

In operation 1030, the walking assistance device 500 determines whether the foot of the user is in contact with the ground based on a pressure value.

Figure 11:
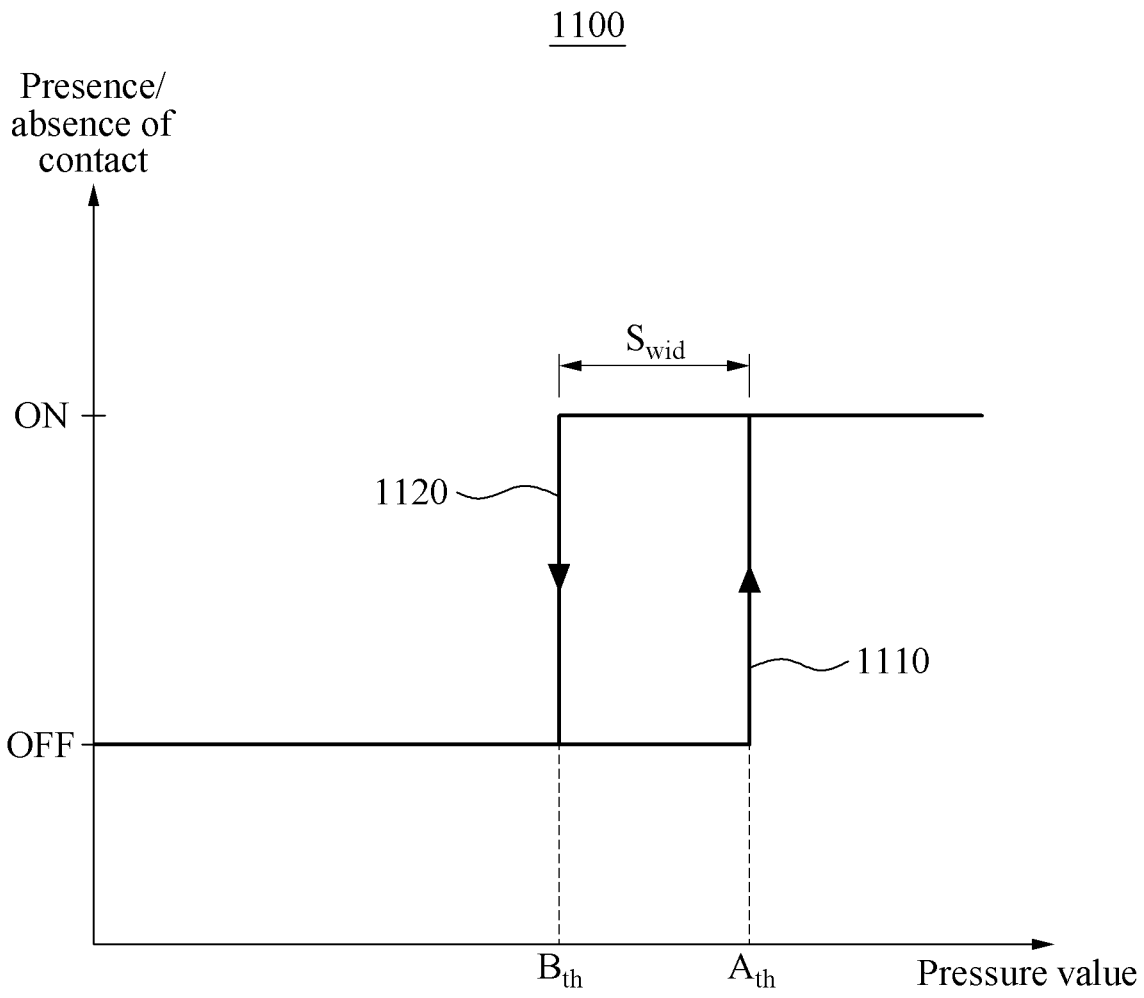
FIG. 11 is a graph to determine a method of determining whether a foot of a user is in contact with the ground using a Schmitt trigger threshold according to at least one example embodiment.

FIG. 11 is a graph to determine a method of determining whether a foot of a user is in contact with the ground using a Schmitt trigger threshold according to at least one example embodiment.

According to an example embodiment, operation 810 of FIG. 8 may include an operation of determining whether the foot of the user is in contact with the ground based on the pressure value using a Schmitt trigger threshold. Depending on example embodiments, a method of determining whether the foot of the user is in contact with the ground based on the pressure value using the Schmitt trigger threshold may be used in operation 1030 of FIG. 10.

For example, the walking assistance device 500 may include a comparator with hysteresis such that the output, indicating whether the foot is in on contact with the ground, remains same until the input pressure value changes sufficiently to trigger a change in the output.

Whether the foot of the user is in contact with the ground (also, referred to as a presence or absence of contact) may be determined using a contact presence/absence determining trajectory 1100. Referring to FIG. 11, in response to an increase in the pressure value, whether the foot of the user is in contact with the ground may be determined based on an ascending trajectory 1110, and, in response to a decrease in the pressure value, may be determined based on a descending trajectory 1120. A threshold $A_{th}$ of the ascending trajectory 1110 and a threshold $B_{th}$ of the descending trajectory 1120 may differ from each other. A gap $S_{wid}$ is present between the threshold $A_{th}$ and the threshold $B_{th}$ to prevent a frequent change in a result of determining whether the foot of the user is in contact with the ground.

Figure 12:
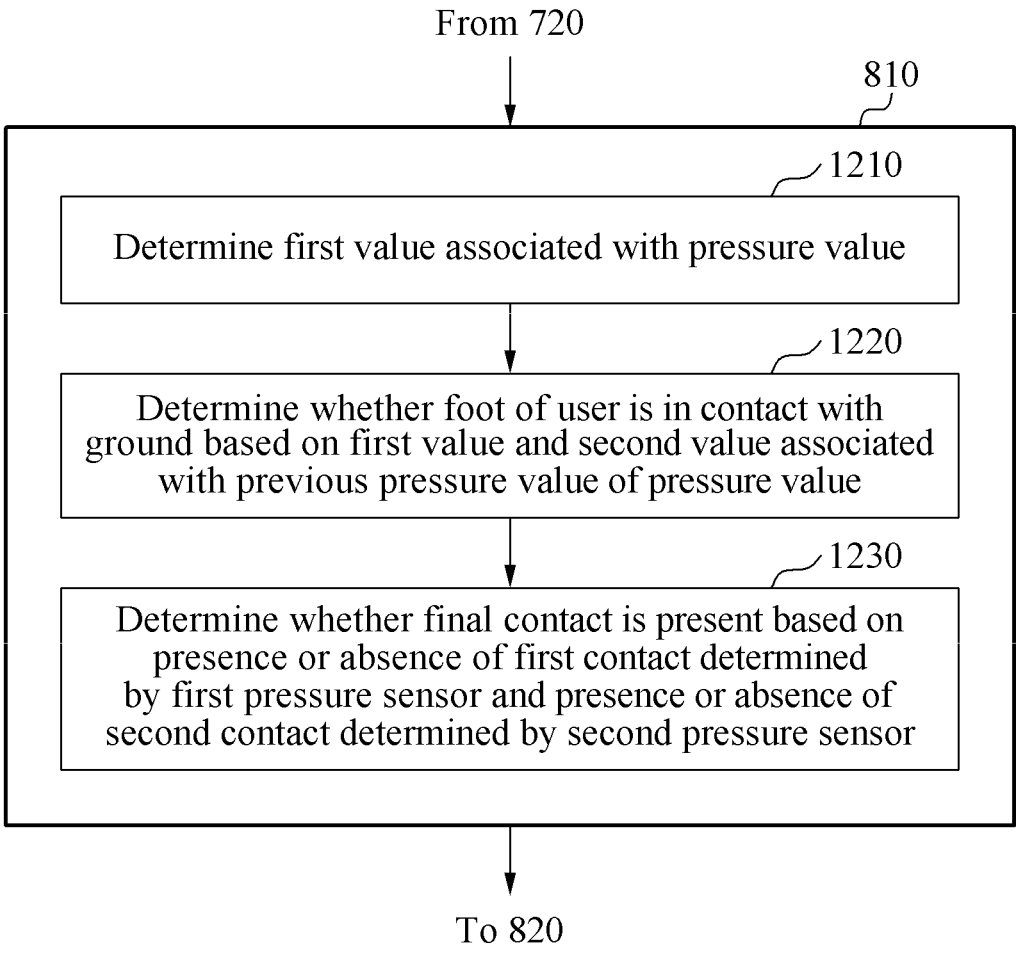
FIG. 12 is a flowchart illustrating a method of determining whether a foot of a user is in contact with the ground based on a current pressure value and a previous pressure value according to at least one example embodiment.

FIG. 12 is a flowchart illustrating a method of determining whether a foot of a user is in contact with the ground based on a current pressure value and a previous pressure value according to at least one example embodiment.

According to an example embodiment, operation 810 of FIG. 8 may include operations 1210 through 1230 of FIG. 8. Depending on example embodiments, operations 1210 through 1230 may be included in operation 1030 of FIG. 10.

Referring to FIG. 12, in operation 1210, the walking assistance device 500 determines a first value associated with a pressure value. Here, the first value may represent whether a pressure value is greater than or equal to a preset threshold. For example, if the pressure value is greater than the threshold, the first value may be "1", and if the pressure value is less than or equal to the threshold, the first value may be "0".

In operation 1220, the walking assistance device 500 determines whether the foot of the user is in contact with the ground based on the first value and a second value associated with a previous pressure value of the pressure value. For example, whether the foot of the user is in contact with the ground may be determined based on a result of performing a logical OR operation using the first value and the second value. The result may be calculated according to Equation 1. Here, Front_Contact[n] denotes the first value, Front_Contact[n−1] denotes the second value, and Front_Contact_Current[n] denotes a result of the logical OR operation.

$$\text{Front_Contact_Current}[n]=\text{Front_Contact}[n]\,||\,\text{Front_Contact_Current}[n-1] \quad \text{[Equation 1]}$$

In Equation 1, n denotes a current point in time and n−1 denotes a previous point in time. However, it is provided as an example only. Thus, n−2 and n−3, that is, values corresponding to previous points in times may be additionally used. If values of previous points in times are frequently used, it may be possible to prevent a frequent change in a result of determining whether of the foot of the user is in contact with the ground.

Front_Contact_Current[n] determined in operation 1220 may be used as a result of determining whether the foot of the user is in contact with the ground. If Front_Contact_Current[n] is a result of a front pressure sensor, Rear_Contact_Current[n] that is a result of a rear pressure sensor may be additionally used to determine whether the foot of the user is in contact with the ground.

In operation 1230, the walking assistance device 500 determines whether a final contact is present based on a presence or an absence of a first contact determined by a first pressure sensor and a presence or an absence of a second contact determined by a second pressure sensor.

The first pressure sensor may correspond to the front pressure sensor, and the second pressure sensor may correspond to the rear pressure sensor. Front_Contact_Current[n] is used to determine the presence or the absence of the first contact and Rear_Contact_Current[n] is used to determine the presence or the absence of the second contact. The presence or the absence of the final contact may be determined using Equation 2. Here, Foot_Contact[n] is a result of the logical OR operation between Front_Contact_Current[n] and Rear_Contact_Current[n].

$$\text{Foot_Contact}[n]=\text{Front_Contact_Current}[n]\,||\,\text{Rear_Contact_Current}[n] \quad \text{[Equation 2]}$$

If a plurality of pressure sensors is provided to a sole of the user and at least one of pressure values measured at the plurality of pressure sensors is greater than or equal to a threshold, the foot of the user may be determined to be in contact with the ground.

Figure 13:
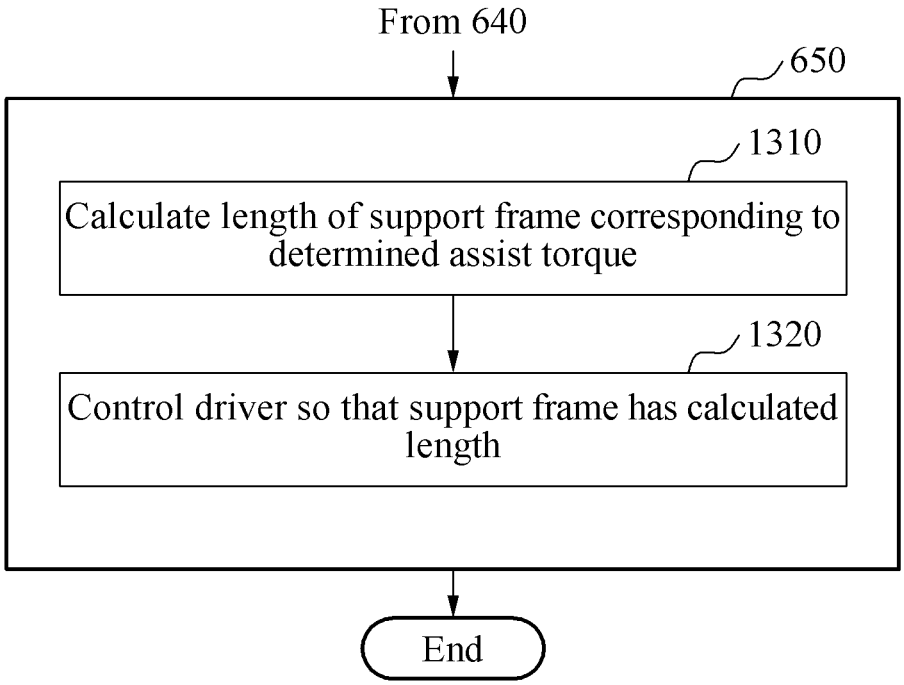
FIG. 13 is a flowchart illustrating a method of controlling a driver by adjusting a length of a support frame according to at least one example embodiment.

FIG. 13 is a flowchart illustrating a method of controlling a driver by adjusting a length of a support frame according to at least one example embodiment.

Operation 650 of FIG. 6 may include operations 1310 and 1320 of FIG. 13. The example embodiment using operations 1310 and 1320 may be associated with the walking assistance device 300 of FIG. 3.

In operation 1310, the walking assistance device 500 calculates a length of a support frame corresponding to a calculated joint angle. For example, a length of a support frame corresponding to a joint angle trajectory may be pre-stored.

In operation 1320, the walking assistance device 500 controls the driver 550 so that the support frame has the calculated length. For example, the driver 550 may adjust the length of the support frame using a power conversion device. The power conversion device may be a device configured to convert a rotary motion of a motor to a linear motion.

A hip-type walking assistance device additionally combinable with the walking assistance device 500 described with reference to FIGS. 5 through 13 will be described with reference to FIGS. 14 and 15. The hip-type walking assistance device may provide a walking assist force to a hip joint of a user. The walking assistance device 500 may be connected to the hip-type walking assistance device through wired communication or wireless communication. The walking assistance device 500 and the hip-type walking assistance device may provide an assist torque to the user in association with a gait phase determined for a movement of the user. For example, the walking assistance device 500 may provide an assist torque to an ankle joint of the user and the hip-type walking assistance device may provide an assist torque to a hip joint of the user.

Hereinafter, the hip-type walking assistance device will be described.

Figure 14:
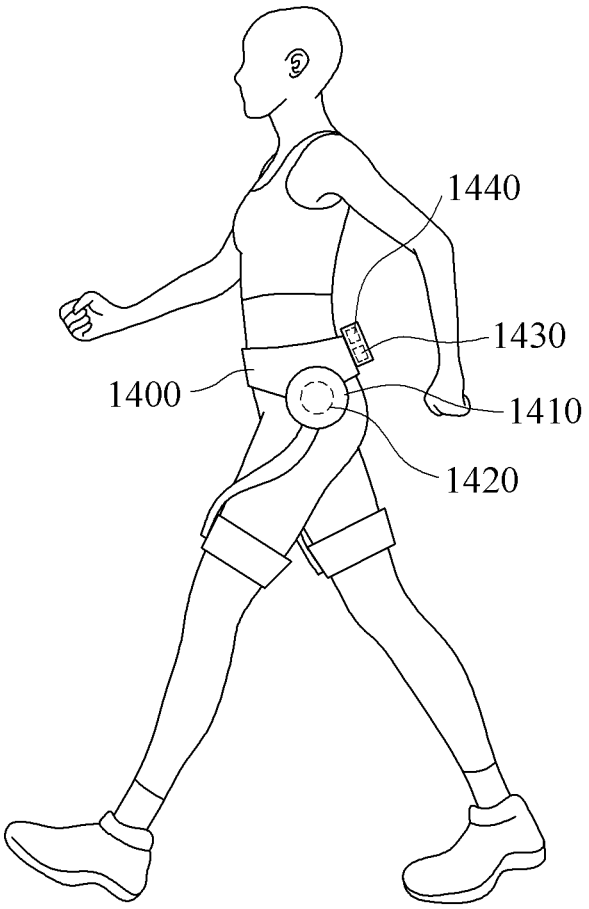
FIGS. 14 and 15 illustrate examples of a hip-type walking assistance device according to at least one example embodiment.
Figure 15:
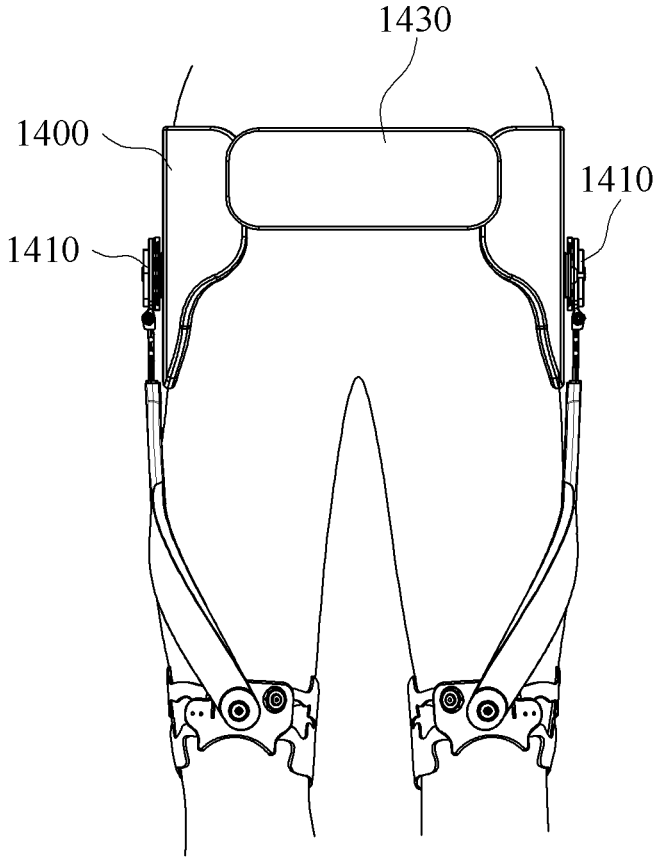

FIGS. 14 and 15 illustrate examples of a hip-type walking assistance device according to at least one example embodiment.

Referring to FIG. 14, a hip-type walking assistance device 1400 is worn by a user and assists walking of the user. The walking assistance device 1400 may be a wearable device.

The example embodiments of FIGS. 14 and 15 may be applicable to a hip type, however, are not limited thereto. Thus, the example embodiments may be applicable to any type of devices that assist walking of the user.

Referring to FIG. 14, the hip-type walking assistance device 1400 includes a driver 1410, a sensor 1420, an IMU 1430, and a controller 1440.

The driver 1410 provides a driving force to a hip joint of the user. For example, the driver 1410 may be provided to a right hip portion and/or a left hip portion of the user. The driver 1410 may include a motor capable of generating a rotational torque.

The sensor 1420 measures an angle of the hip joint of the user during walking. Information associated with the angle of the hip joint of the user sensed at the sensor 1420 may include an angle of a right hip joint, an angle of a left hip joint, a difference between the angle of the right hip joint and the angle of the left hip joint, and a hip joint motion direction. For example, the sensor 1420 may be included in the driver 1410.

The sensor 1420 may include a potentiometer. The potentiometer may sense a right (R) axis joint angle, a left (L) axis joint angle, an R axis joint acceleration, and an L axis joint acceleration according to a gait motion of the user.

The IMU 1430 may measure acceleration and posture information during walking. For example, the IMU 1430 may sense each of X axis, Y axis, and Z axis acceleration, and X axis, Y axis, and Z axis angular velocity according to a gait motion of the user.

The hip-type walking assistance device 1400 may detect a point at which a foot of the user lands based on acceleration information measured by the IMU 1530.

In addition to the sensor 1420 and the IMU 1430, the hip-type walking assistance device 1400 may include other sensors, for example, an electromyogram (EMG) sensor and an electroencephalogram (EEG) sensor capable of sensing a change in biosignals or momentum of the user according to the gait motion of the user.

The controller 1440 controls the driver 1410 to output an assistance force to assist walking of the user. For example, the hip-type walking assistance device 1400 may include two drivers 1410 on a left hip and a right hip of the user, respectively, and the controller 1440 may output control signals for controlling the two drivers 1410 to generate a torque. The controller 1440 may include a communicator, a processor, and a memory.

The driver 1410 generates a torque in response to the control signal output from the controller 1440. The hip-type walking assistance device 1400 may include the driver 1410 for a right leg of the user and the driver 1410 for a left leg of the user. For example, the controller 1440 may be designed to control one of the drivers 1410. If the controller 1440 controls only a single driver 1410, a number of controllers 1440 may be provided. As another example, the controller 1440 may be designed to control all of the drivers 1410 for the left leg and the right leg of the user.

Unlike the hip-type walking assistance device 1400 described with reference to FIGS. 14 and 15, the walking assistance device 500 of FIG. 5 may be included in a body-type walking assistance device 1 that is described with reference to FIGS. 16 through 18. The body-type walking assistance device 1 may provide a walking assistance force to each of a hip joint, a knee joint, and an ankle joint of the user.

Hereinafter, the body-type walking assistance device will be described.

Figure 16:
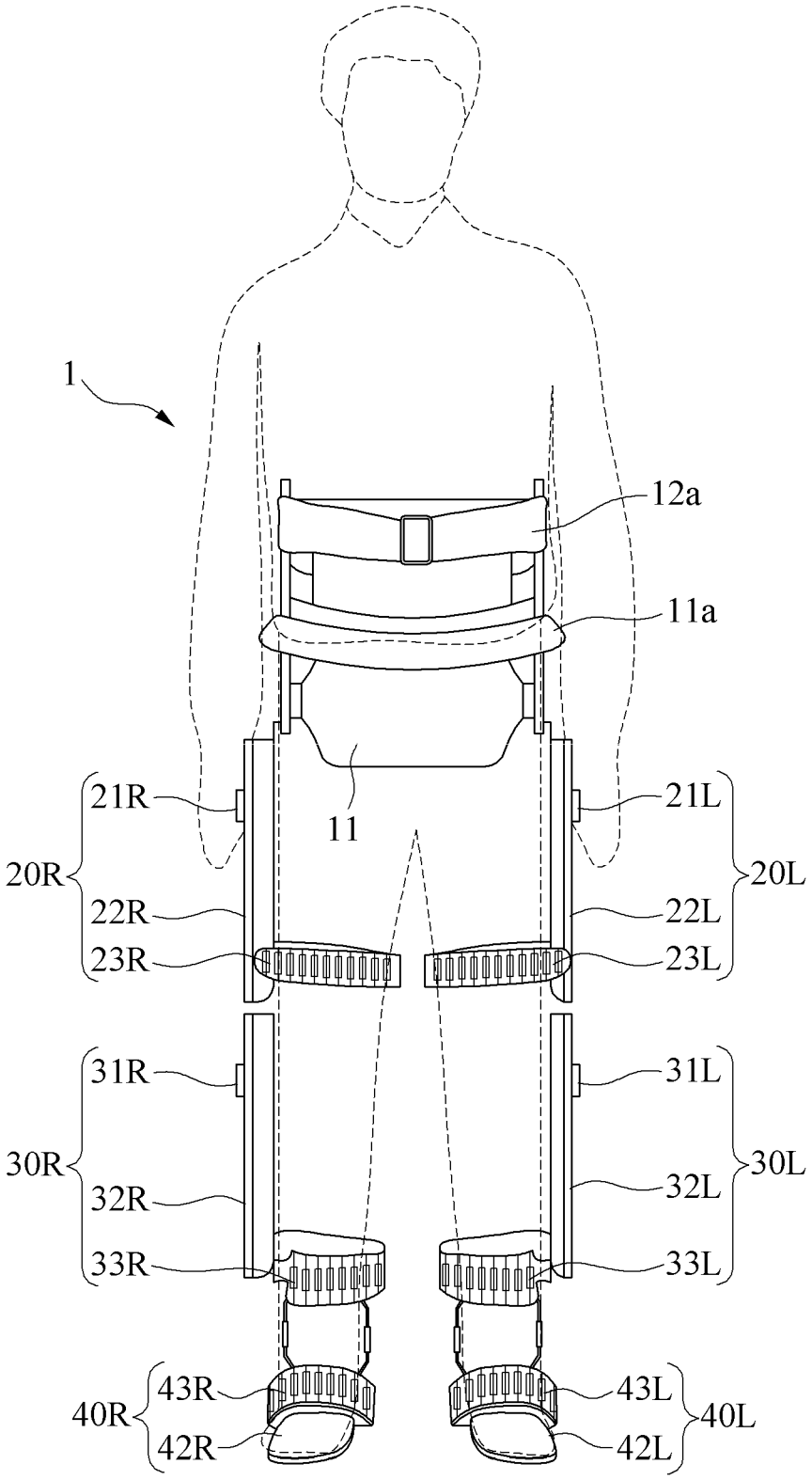
FIGS. 16 through 18 illustrate examples of a body-type walking assistance device according to at least one example embodiment.
Figure 17:
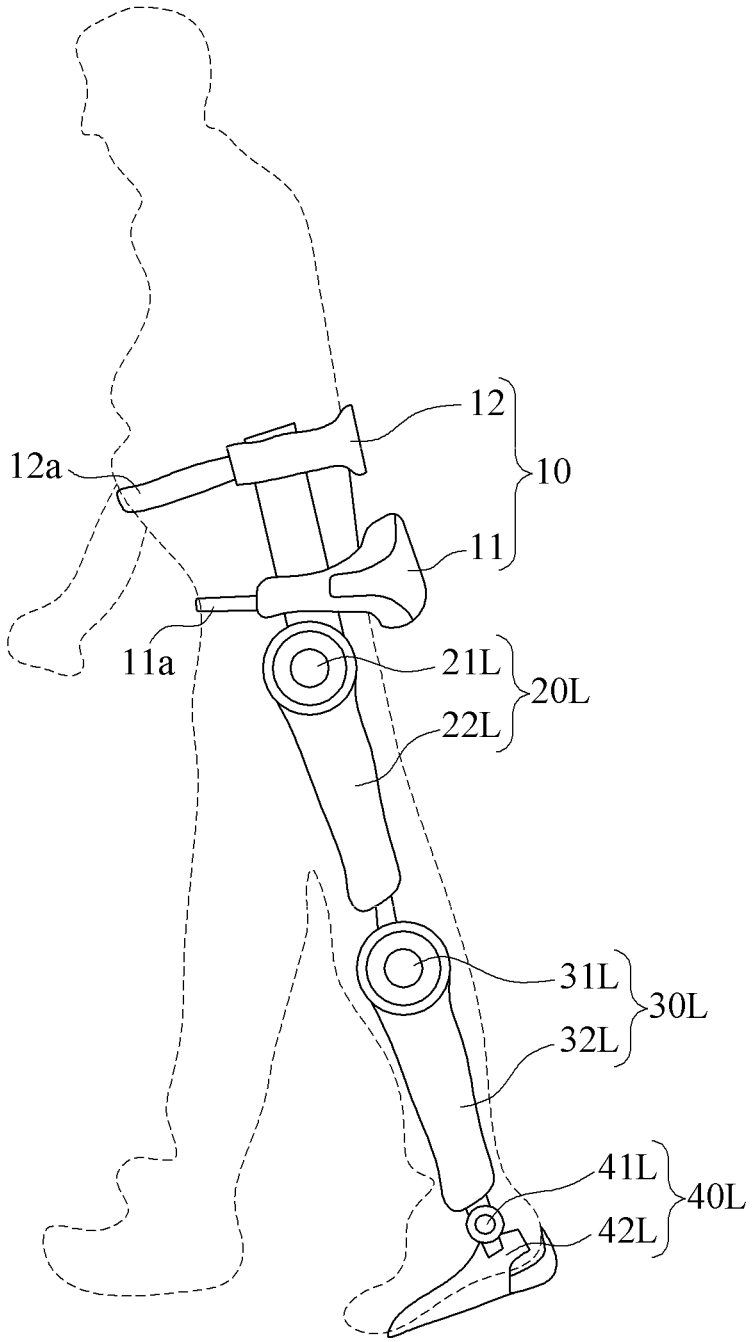
Figure 18:
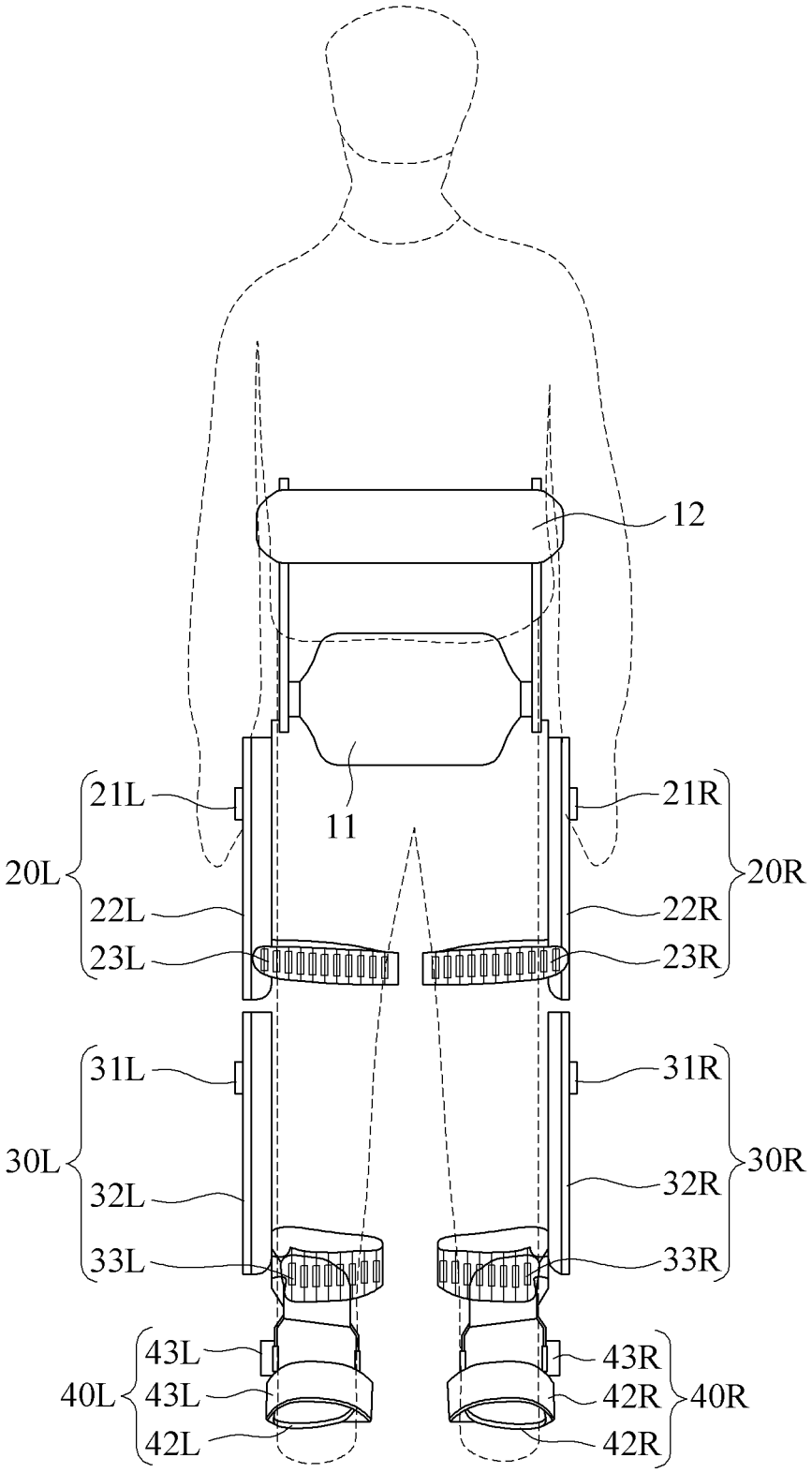

FIGS. 16 through 18 illustrate examples of a body-type walking assistance device according to at least one example embodiment. FIG. 16 is a front view of the body-type walking assistance device 1, FIG. 17 is a side view of the body-type walking assistance device 1, and FIG. 18 is a rear view of the body-type walking assistance device 1.

According to an example embodiment, the body-type walking assistance device 1 may include the driver 1410, the sensor 1420, the IMU 1430, and the controller 1440 of FIG. 14.

Referring to FIGS. 16 through 18, the body-type walking assistance device 1 is in an exoskeleton structure to be wearable to each of a left leg and a right leg of a user. The user may perform a motion, for example, an extension motion, a flexion motion, an adduction motion, and an abduction motion, with wearing the body-type walking assistance device 1. The extension motion is a movement that extends a joint, and the flexion motion is a movement that flexes a joint. The adduction motion is a movement that moves a leg to be close to a central axis of the body, and the abduction motion is a movement that extends a leg to be away from the central axis of the body.

Referring to FIGS. 16 through 18, the body-type walking assistance device 1 may include a body 10 and a mechanical part, for example, first structural parts 20R and 20L, second structural parts 30R and 30L, and third structural parts 40R and 40L.

The body 10 may include a housing 11. Various parts may be embedded in the housing 11. The parts embedded in the housing 11 may include, for example, a central processing unit (CPU), a printed circuit board (PCB), various types of storage devices, and a power source. For example, the body 10 may include the controller 1440. The controller 1440 may include the CPU and the PCB.

The CPU may be a microprocessor. The microprocessor may include an arithmetic logic operator, a register, a program counter, a command decoder and/or a control circuit in a silicon chip. The CPU may generate a control mode suitable for a walking environment, and may generate a control signal for controlling an operation of a mechanical part based on the selected control mode.

The PCB refers to a board on which a desired (or, alternatively, a predetermined) circuit is printed and may include the CPU and/or various storage devices. The PCB may be fixed in the housing 11.

Various types of storage devices may be included in the housing 11. The storage devices may include a magnetic disk storage device to store data by magnetizing the surface of a magnetic disk and a semiconductor memory device to store data using various types of memory semiconductors.

The power source embedded in the housing 11 may supply power to various types of parts embedded in the housing 11 or the mechanical part, for example, the first structural parts 20R and 20L, the second structural parts 30R and 30L, and the third structural parts 40R and 40L.

The body 10 may further include a waist support 12 configured to support a waist of the user. The waist support 12 may be in a shape of a curved flat plate to support the waist of the user.

The body 10 may further include a fastener 11*a* configured to fasten the housing 11 to a hip portion of the user and a fastener 12*a* configured to fasten the waist support 12 to the waist of the user. The fastener 11*a*, 12*a* may be configured as one of a band, a belt, and a strap having elasticity.

The body 10 may include the IMU 1430. For example, the IMU 1430 may be provided outside or inside the housing 11. The IMU 1430 may be installed on the PCB embedded in the housing 11. The IMU 1430 may measure an acceleration and an angular velocity.

Referring to FIGS. 16 through 18, the mechanical part may include the first structural part 20R, 20L, the second structural part 30R, 30L, and the third structural part 40R, 40L The first structural part 20R, 20L may assist a motion of a femoral region and a hip joint of the user during a gait operation. The first structural parts 20R and 20L may include first drivers 21R and 21L, first supports 22R and 22L, and first fasteners 23R and 23L, respectively.

The driver 1410 may include the first driver 21R, 21L. The description related to the driver 1410 made with reference to FIGS. 14 through 15 may be applied to the first driver 21R, 21L.

The first driver 21R, 21L may be provided at a location of a corresponding hip joint of the first structural part 20R, 20L, and may generate a rotational force in a desired (or, alternatively, a predetermined) direction at various magnitudes. The rotational force generated by the first driver 21R, 21L may be applied to the first support 22R, 22L. The first driver 21R, 21L may be set to rotate within the movement range of a hip joint of the human body.

The first driver 21R, 21L may be driven in response to a control signal provided from the body 10. Although the first driver 21R, 21L may be configured as one of a motor, a vacuum pump, and a hydraulic pump, it is provided as an example only.

A joint angle sensor may be installed around the first driver 21R, 21L. The joint angle sensor may detect an angle at which the first driver 21R, 21L rotates based on a rotational axis. The sensor 1420 may include the joint angle sensor.

The first support 22R, 22L may be physically connected to the first driver 21R, 21L. The first support 22R, 22L may rotate in a desired (or, alternatively, a predetermined) direction based on the rotational force generated by the first driver 21R, 21L.

The first support 22R, 22L may be provided in various shapes. For example, the first support 22R, 22L may be in a shape in which a plurality of knuckles is inter-connected. Here, a joint may be provided between the knuckles. The first support 22R, 22L may bend within a desired (or, alternatively, a predetermined) range by the joint. As another example, the first support 22R, 22L may be provided in a bar shape. Here, the first support 22R, 22L may be configured using a flexible material to be bendable within a desired (or, alternatively, a predetermined) range.

The first fastener 23R, 23L may be provided to the first support 22R, 22L. The first fastener 23R, 23L serves to fasten the first support 22R, 22L to a corresponding femoral region of the user.

FIGS. 16 through 18 illustrate an example in which the first supports 22R and 22L are fastened to the outside of the femoral regions of the user by the first fasteners 23R and 23L, respectively. If the first support 22R, 22L rotates in response to driving of the first driver 21R, 21L, the femoral region to which the first support 22R, 22L is fastened may rotate in the same direction in which the first support 22R, 22L rotates.

The first fastener 23R, 23L may be configured as one of a band, a belt, and a strap having elasticity, or may be configured using a metal material. FIG. 16 illustrates an example in which the first fastener 23R, 23L is configured using a chain.

The second structural part 30R, 30L may assist a motion of a lower leg and a knee joint of the user during a gait operation. The second structural parts 30R and 30L include second drivers 31R and 31L, second supports 32R and 32L, and second fasteners 33R and 33L, respectively.

The second driver 31R, 31L may be provided at a location of a corresponding knee joint of the second structural part 30R, 30L, and may generate a rotational force in a desired (or, alternatively, a predetermined) direction at various magnitudes. The rotational force generated by the second driver 31R, 31L may be applied to the second support 22R, 22L. The second driver 31R, 31L may be set to rotate within a movement range of a knee joint of the human body.

The driver 1410 may include the second driver 31R, 31L. The description related to the hip joint made with reference to FIGS. 14 and 15 may be similarly applied to the knee joint.

The second driver 31R, 31L may be driven in response to a control signal provided from the body 10. Although the second driver 31R, 31L may be configured as one of a motor, a vacuum pump and a hydraulic pump, it is provided as an example only.

A joint angle sensor may be installed around the second driver 31R, 31L. The joint angle sensor may detect an angle at which the second driver 31R, 31L rotates based on a rotational axis. The sensor 1420 may include the joint angle sensor.

The second support 32R, 32L may be physically connected to the second driver 31R, 31L. The second support 32R, 32L may rotate in a desired (or, alternatively, a predetermined) direction based on the rotational force generated by the second driver 31R, 31L.

The second fastener 33R, 33L may be provided to the second support 32R, 32L. The second fastener 33R, 33L serves to fasten the second support 32R, 32L to a lower leg portion of the user. FIGS. 16 through 18 illustrate an example in which the second supports 32R and 32L are fastened at the outside of lower leg portions of the user by the second fasteners 33R and 33L, respectively. If the second support 33R, 33L rotates in response to driving of the second driver 31R, 31L, the lower leg portion to which the second support 33R, 33L is fastened may rotate in the same direction in which the second support 33R, 33L rotates.

The second fastener 33R, 33L may be configured as one of a band, a belt, and a strap having elasticity, or may be configured using a metal material.

The third structural part 40R, 40L may assist a motion of an ankle joint and related muscles of the user during a gait operation. The third structural parts 40R and 40L may include third drivers 41R and 41L, foot supports 42R and 42L, and third fasteners 43R and 43L, respectively.

The driver 1410 may include the third driver 41R, 41L. The description related to the hip joint made with reference to FIGS. 14 and 15 may be similarly applied to the ankle joint.

The third driver 41R, 41L may be provided to a corresponding ankle joint of the third structural part 40R, 40L, and may be driven in response to a control signal provided from the body 10. Similar to the first driver 21R, 21L or the second driver 31R, 31L, the third driver 41R, 41L may be configured as a motor.

A joint angle sensor may be installed around the third driver 41R, 41L. The joint angle sensor may detect an angle at which the third driver 41R, 41L rotates based on a rotational axis. The sensor 1420 may include the joint angle sensor.

The foot support 42R, 42L may be provided at a location corresponding to a sole of the user, and may be physically connected to the third driver 41R and 41L.

A pressure sensor configured to detect a weight of the user may be provided to the foot support 42R, 42L. A detection result of the pressure sensor may be used to determine whether the user is wearing the walking assistance device 1, whether the user stands, whether a foot of the user is in contact with the ground, and the like.

The third fastener 43R, 43L may be provided to the foot support 42R, 42L. The third fastener 43R, 43L serves to fasten a foot of the user to the foot support 42R, 42L.

According to an example embodiment, the third mechanical part 40R, 40L may be the walking assistance device 500 of FIG. 5. For example, the sensor 510 may include a joint angle sensor and a pressure sensor and the driver 550 may be the third driver 41R, 41L The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A walking assistance method performed by a walking assistance device, the method comprising:

receiving, from at least one pressure sensor, a pressure value indicating an amount of pressure applied to a sole of a user;

receiving, from an acceleration sensor, acceleration information associated with a movement of the user;

determining whether the user is in a walking state in response to the acceleration information indicating that a magnitude of acceleration is greater than an acceleration threshold;

determining a gait phase of the user based on the pressure value only in response to determining that the user is in the walking state based on the magnitude of acceleration being greater than the acceleration threshold;

determining an assist torque corresponding to the gait phase; and controlling a driver to output the assist torque, wherein the determining the gait phase comprises:

determining whether a change of a contact state occurs within a pre-set time period, the pre-set time period being a duration of time in the past relative to a present time;

maintaining a current contact state in response to the change of the contact state occurring within the pre-set time period;

determining whether a foot of the user is in contact with a ground based on the pressure value, in response to the change of the contact state not occurring within the pre-set time period; and determining the gait phase based on whether the foot of the user is in contact with the ground.

2. The method of claim 1, wherein the determining whether the foot of the user is in contact with the ground comprises:

receiving, from the at least one pressure sensor, a first pressure value indicating the amount of pressure applied to the sole of the user at a first time;

receiving, from the at least one pressure sensor, a second pressure value indicating the amount of pressure applied to the sole of the user at a second time, the second time being different from the first time; and determining whether the foot of the user is in contact with the ground based on the first pressure value and the second pressure value.

3. The method of claim 2, wherein the determining whether the foot of the user is in contact with the ground further comprises:

receiving, from a first pressure sensor of the at least one pressure sensor, the first pressure value;

receiving, from a second pressure sensor of the at least one pressure sensor, the second pressure value, the first pressure sensor and the second pressure sensor being provided at different locations of the foot of the user; and determining whether the foot of the user is in contact with the ground based on the first pressure value and the second pressure value.

4. The method of claim 1, wherein the determining whether the user is in the walking state comprises:

calculating the magnitude of acceleration of the user based on the acceleration information;

determining that the user is in the walking state in response to the magnitude of acceleration being greater than the acceleration threshold; and determining that the user is in a stand state in response to the magnitude of acceleration being less than or equal to the acceleration threshold.

5. The method of claim 1, wherein the determining of the gait phase comprises:

determining a target gait phase corresponding to gait information among preset gait phases.

6. The method of claim 1, wherein the driver is configured to provide the assist torque to an ankle of the user.

7. The method of claim 1, wherein the controlling of the driver comprises:

calculating a desired length of a support frame corresponding to the assist torque; and controlling the driver to adjust an actual length of the support frame to the desired length.

8. A non-transitory computer-readable recording medium storing instructions that, when executed by a processor, cause the processor to perform the method of claim 1.

9. A walking assistance device comprising:

a memory configured to store a program to assist a user with walking; and a processor configured to execute the program to, receive, from at least one pressure sensor, a pressure value indicating an amount of pressure applied to a sole of the user, receive, from an acceleration sensor, acceleration information associated with a movement of the user, determine whether the user is in a walking state in response to the acceleration information indicating that a magnitude of acceleration is greater than an acceleration threshold, determine a gait phase of the user based on the pressure value only in response to determining that the user is in the walking state based on the magnitude of acceleration being greater than the acceleration threshold, determine an assist torque corresponding to the gait phase, and control a driver to output the assist torque, wherein the processor is configured to determine the gait phase by, determining whether a change of a contact state occurs within a pre-set time period, the pre-set time period being a duration of time in the past relative to a present time, maintaining a current contact state in response to the change of the contact state occurring within the pre-set time period, determining whether the foot of the user is in contact with a ground based on the pressure value in response to the change of the contact state not occurring within the pre-set time period, and determining the gait phase based on whether a foot of the user is in contact with the ground.

10. The walking assistance device of claim 9, wherein the processor is configured to determine whether the foot of the user is in contact with the ground by, receiving, from the at least one pressure sensor, a first pressure value indicating the amount of pressure applied to the sole of the user at a first time, receiving, from the at least one pressure sensor, a second pressure value indicating the amount of pressure applied to the sole of the user at a second time, the second time being different from the first time, and determining whether the foot of the user is in contact with the ground based on the first pressure value and the second pressure value.

11. The walking assistance device of claim 9, wherein the processor is configured to determine whether the user is in the walking state by, calculating the magnitude of acceleration of the user based on the acceleration information, determining that the user is in the walking state in response to the magnitude of acceleration being greater than the acceleration threshold, and determining that the user is in a stand state in response to the magnitude of acceleration being less than or equal to the acceleration threshold.

* * * * *